US005961346A

United States Patent [19]

Choy

[11] Patent Number: 5,961,346

[45] Date of Patent: Oct. 5, 1999

[54] BOARDLOCK FOR USE WITH SLANTED CARD EDGE CONNECTOR

[75] Inventor: Edmond Choy, Union City, Calif.

[73] Assignee: Hon Hai Precision Inc. Co., Ltd., Taipei Hsien, Taiwan

[21] Appl. No.: 08/903,506

[22] Filed: Jul. 30, 1997

[51] Int. Cl.[6] ..... H01R 13/60

[52] U.S. Cl. ..... 439/567; 439/326

[58] Field of Search ..... 439/567, 326, 439/571, 570

[56] References Cited

U.S. PATENT DOCUMENTS

| | | | |
|---|---|---|---|
| 4,917,624 | 4/1990 | Yu | 439/326 |
| 5,041,005 | 8/1991 | McHugh | 439/326 |
| 5,228,870 | 7/1993 | Gorenc et al. | 439/571 |
| 5,460,537 | 10/1995 | Noschese | 439/326 |
| 5,511,985 | 4/1996 | Noschese et al. | 439/637 |

*Primary Examiner*—Gary Paumen
*Assistant Examiner*—Antoine Ngandjui

[57] ABSTRACT

A slanted card edge connector (10) includes an insulative housing (12) defining a central slot (14) for receiving a module therein and a pair of ejectors (18) rotatably positioned within a pair of corresponding towers (16) adjacent two opposite ends of the housing (12). Three support blocks (20) extend forward and backward from a center portion and two opposite end portions wherein the middle support block (20) includes a slanted first cavity (24), in compliance with the relative angle of housing (12) with regard to the PC board (100), extending from a front surface (26) thereof inwardly, and each of such other two end blocks (20) also has the second slanted cavity (50), in compliance with the relative angle of the housing (12) with regard to the PC board (100), extending from a bottom surface (52) thereof. Therefore, these three support blocks (20) are not collinear along the lengthwise direction of the housing (12) of the connector (20).

14 Claims, 4 Drawing Sheets

BOARDLOCK FOR USE WITH SLANTED CARD EDGE CONNECTOR

BACKGROUND OF THE INVENTION

1. Field of the Invention

The invention relates to card edge connectors, and particularly to the arrangement of a boardlock retained within a housing of a slanted DIMM (Dual In-line Memory Module) connector.

2. The Related Art

U.S. Pat. No. 5,511,985 discloses the slanted DIMM connector on a PC board for receiving a corresponding module therein. U.S. Pat. Nos. 4,917,624 and 5,460,537 also disclose slanted type card edge connectors. All of them generally use a traditional integral retention post for retain the connector on the PC board. Anyhow, none of them teach using a resilient metal-made boardlock with this slanted type housing of the connector.

Therefore, an object of the invention is to provide a metal boardlock with the slanted type connector housing. Understandably, two issues should be considered wherein the first is that because the slanted type connector's housing is generally angular to the PC board on which it is mounted, the additional support blocks are required to be formed on the under-surface of the housing to increase the standing area of the whole connector. Secondly, a cavity is required to be formed in the housing to receive the corresponding metal boardlock and such cavity is desired to be formably molded by directly using a pair of male-female dies which are operated in opposite directions without using any redundant slide cores which does not comply with the molding direction, i.e., such operation direction. Because almost cavities or passageways in the slanted type connector housing are substantially at a similar angle with regard to the PC board, it is expected that the cavity adapted to receive the corresponding boardlock should also follow this format. Additionally, because the expanded standing area is acquired by adding several support blocks unto the bottom of the slanted housing of the connector, the number of boardlock is designedly set to be more than one and the positions of such boardlocks are intentionally arranged offset from each other in the lateral direction of the housing, i.e., all boardlocks being not collinear along the lengthwise direction of the housing.

SUMMARY OF THE INVENTION

According to an aspect of the invention, a slanted card edge connector includes an insulative housing defining a central slot for receiving a module therein and a pair of ejectors rotatably positioned within a pair of corresponding towers adjacent two opposite ends of the housing. Three support blocks extend forward and backward from a center portion and two opposite end portions wherein the middle support block includes a slanted first cavity, in compliance with the relative angle of housing with regard to the PC board, extending from a front surface thereof inwardly, and each of such two end blocks also has the second slanted cavity, in compliance with the relative angle of the housing with regard to the PC board, extending from a bottom surface thereof. Therefore, these three support blocks are not collinear along the lengthwise direction of the housing of the connector.

DETAILED DESCRIPTION OF THE PREFERRED EMBODIMENTS

Figure 1:
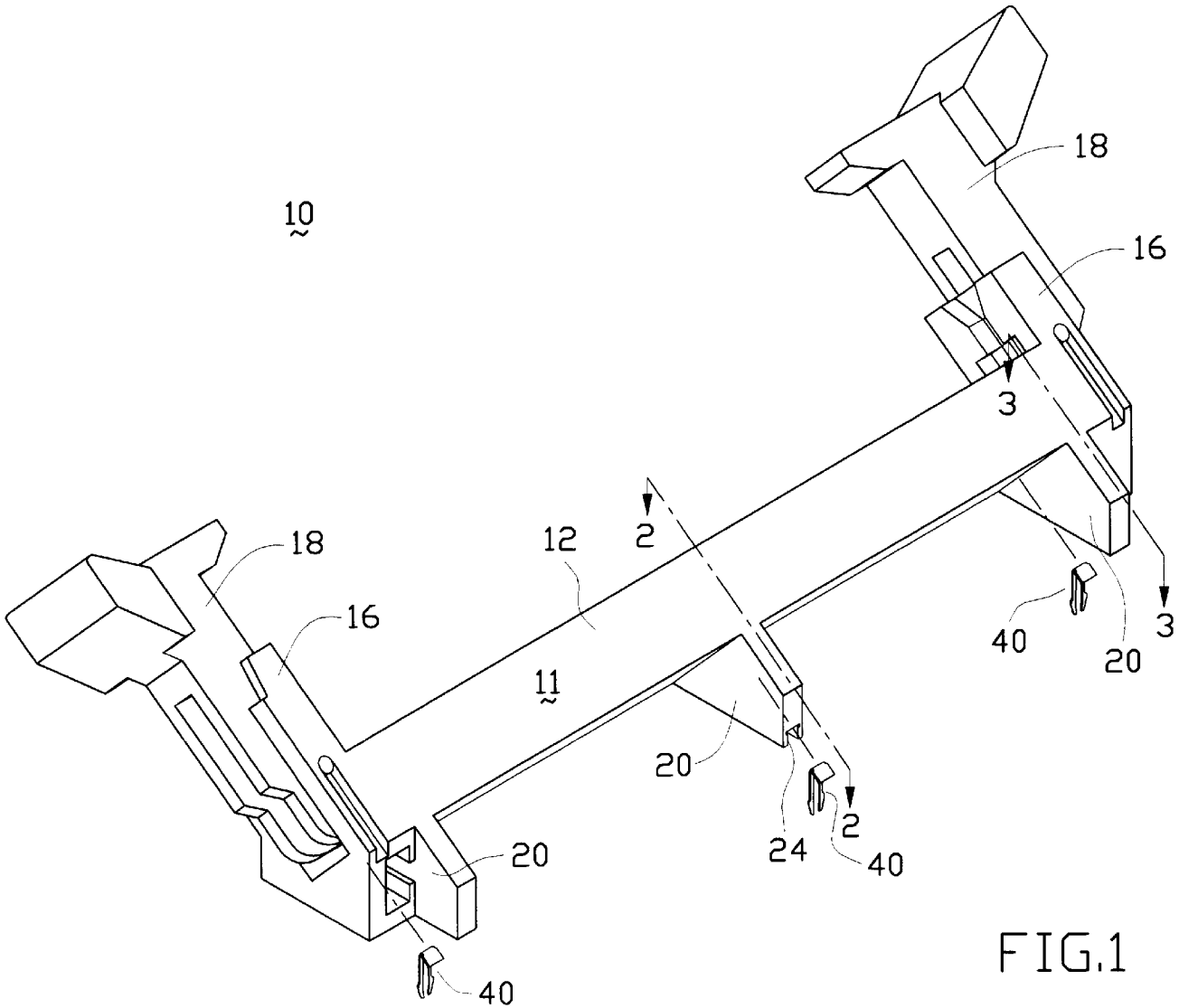
FIG. 1 is a front perspective view of a presently preferred embodiment of the slanted DIMM connector without contacts therein, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein a slanted (25 degrees) DIMM connector 10 includes an insulative housing 12 defined a central slot 14 with two rows of contacts (not shown) by two side thereof to receive a module (not shown) therein. A pair of raised towers 16 are formed at two opposite ends of the housing 12 each for receiving a rotatable ejector 18 therein. The ejector 18 cooperates with the module to retain or release the module in or from the housing 12.

To stabilize the housing 12 on the PC board 100, three support blocks 20 integrally extend forward and backward from a underside of the housing 12 with a predetermined distance. These blocks 20 provides not only additional support points for enlargement of the seating area of the housing 12, but also protection walls for covering the contact tails (not shown) in the lateral direction and preventing the contact tails (not shown) from the lateral hit.

To replace the traditional plastic posts integrally extending from the bottom surface of the housing 12, the invention provides three resilient metal boardlocks 40 on the blocks 20, respectively. To receive the respective boardlock 20, each block 20 forms a cavity 24 or 50 around its bottom portion.

Figure 2:
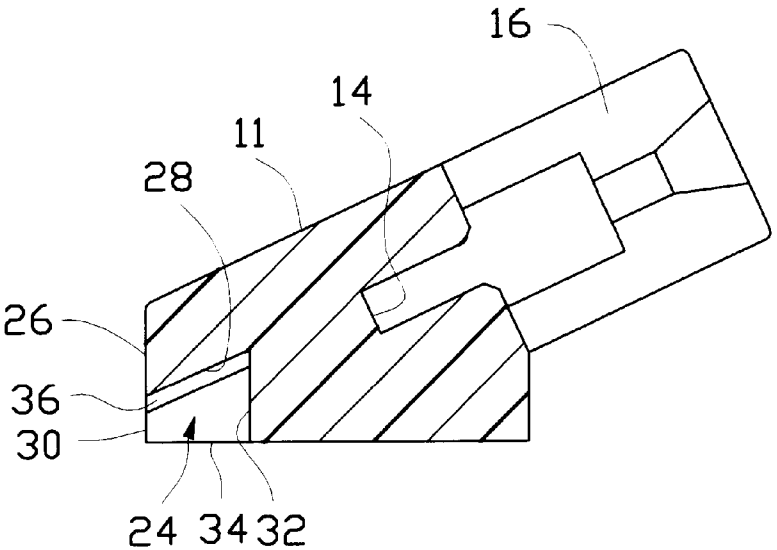
FIG. 2 is a cross-sectional view along line X—X of the connector of FIG. 1 to show the cavity in the central block.
Figure 4:
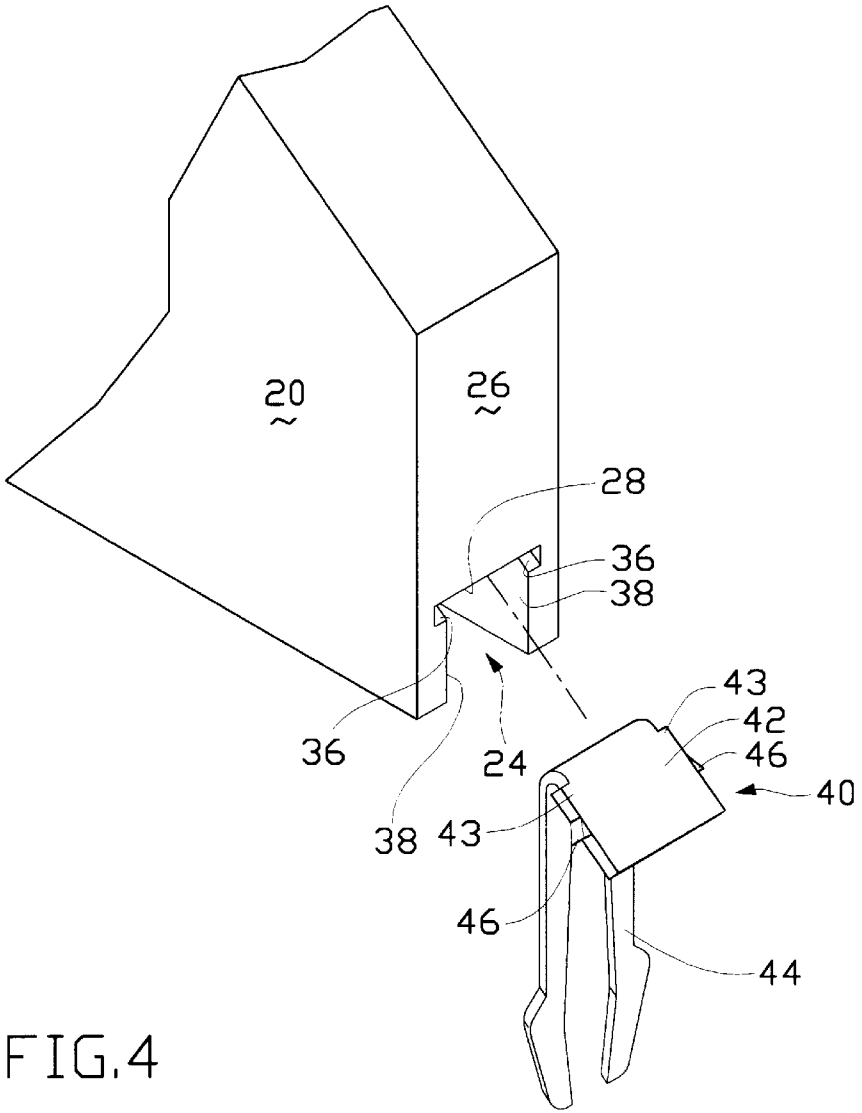
FIG. 4 is an enlarged fragmentary view cut-away from the central block to show the structure relationship between the boardlock and the block.

As shown in FIGS. 2 and 4, the central block 20 defines a first cavity 24 inward extends from the front surface 26 toward the rear portion of the housing 12 wherein the first cavity 24 generally has a trapezoid cross-section configuration including an upward slanted side 28, which is generally parallel to a top surface 11 of the housing 12, two parallel vertical front side 30 and end side 32, and a horizontal bottom side 34. A pair of slots 36 extends along the upward slanted side 28 by two internal side walls 38.

Correspondingly, a boardlock 40 includes an attaching plate 42 with barbs 46 on two side edges, and a pair of mounting legs 44 extending downward from an inner edge of the plate 42 wherein the plate 42 extends in compliance with the upward slanted side 28 and at an angle with the integral legs 44. In other words, the attaching plate 42 and the legs 44 are neither parallel to and perpendicular to each other but with an angle therebetween which generally smaller than a right angle. Therefore, the boardlock 40 can be inserted into the corresponding cavity 24 from the front surface 26 inward, i.e., rearward with two side edges of the plate 42 are received within the corresponding slots 36 until the legs 44 generally abut against the end side 32 of the cavity 24. As a result, the boardlock 40 is retained within the corresponding cavity 24 by retention due to the barbs 46 abutting against internal surface in the slot 36, and naturally such pair of legs 44 extend downward through the whole cavity 24 and out of the bottom side 34 for being ready to be received within a corresponding boardlock hole (not shown) in the PC board 100.

Figure 3:
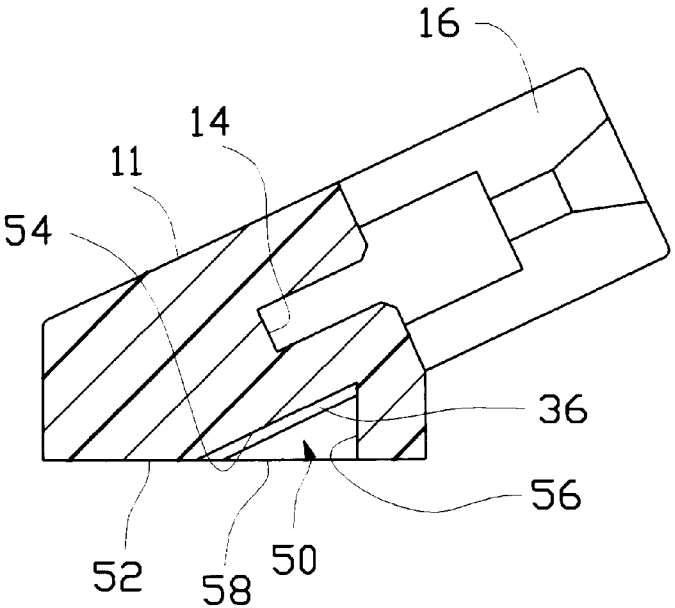
FIG. 3 is a cross-sectional view of the connector of FIG. 1 along line Y—Y to show the cavity in the end block.

Similarly, as shown in FIG. 3, each end block 20 also has a cavity 50 for receiving the corresponding boardlock 40. Differently, each cavity 50 extends from a bottom surface 52 of the block 20 and has a triangle cross-section configuration including an upward slanted side 54, a vertical end side 56 and a bottom side 58. Accordingly, the boardlock 40 is inserted into the cavity 50 from the bottom surface 52 and moved upward and rearward along the upward slanted side 54 with two side edges 43 of the plate 42 moving along the corresponding slots 36 until the legs 44 confront the end side 56. Under this situation, the boardlock 40 can be retained in position in the cavity 50 by barbs 46 being interferentially engaged within the corresponding slot 36.

Figure 5:
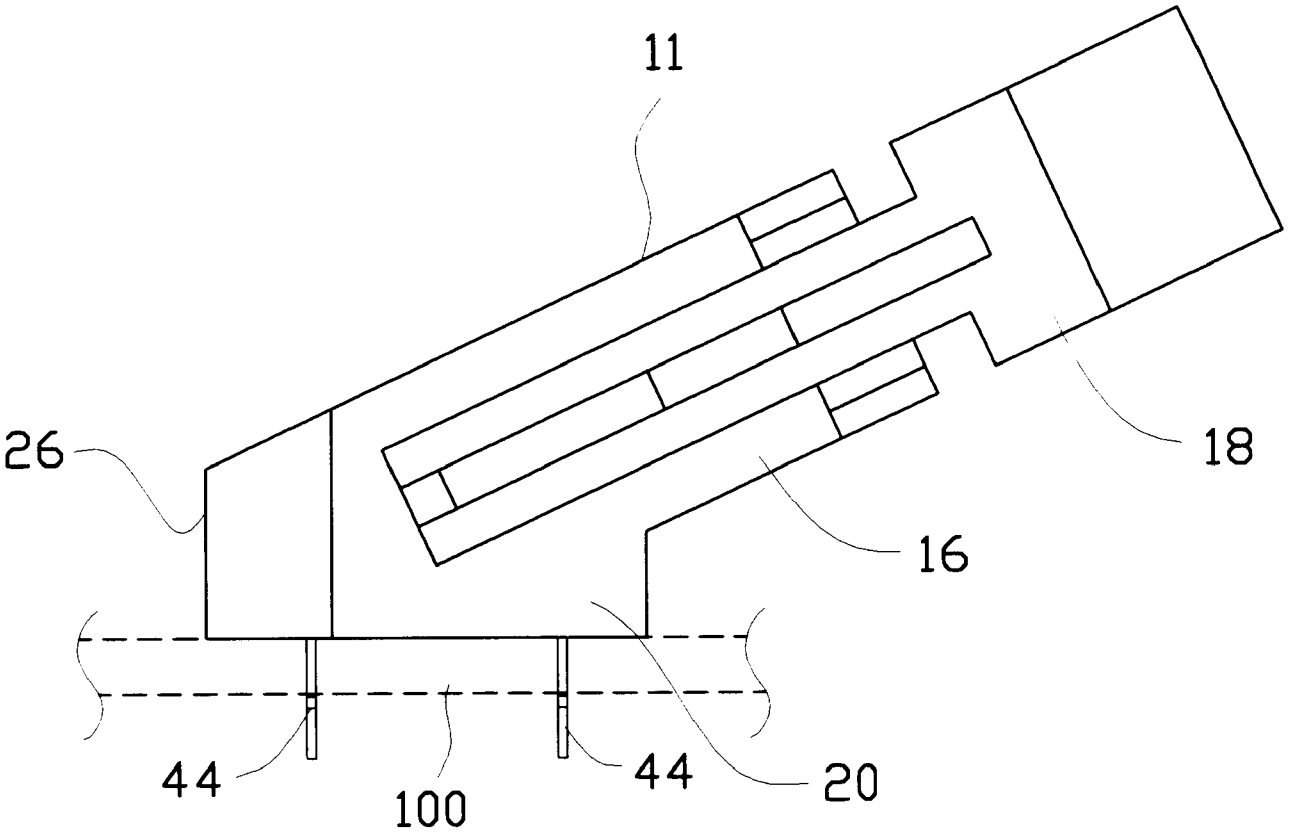
FIG. 5 is a side view of the connector of FIG. 1 to show the boardlocks are not collinear along the elongated direction of the housing.

Referring to FIG. 5, when three boardlocks 40 are completely installed within the corresponding cavities 20, 50, respectively, the boardlock 40 in the cavity 20 is positioned closer to the front surface 26 of the block 20 than the boardlock 40 in the cavity 50 to the front surface 26 of the corresponding block 20. In other words, These three boardlocks 40 are not collinear and substantially offset from each other in a lateral direction with regard to the housing.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A slanted card edge connector for mounting to a PC board, comprising:

an insulative elongated housing defining a central slot for receiving a module therein, said housing being positioned with regard to the PC board at an angle which is substantially smaller than a right angle;

at least one block integrally formed on an underside of the housing;

a cavity formed around a bottom portion of said block; and a boardlock including an attachment plate and legs extending downward from said attachment plate, said attachment plate defining a first plane and said legs defining a second plate wherein an oblique angle is formed between said first and second planes; whereby said boardlock can be loaded into said cavity from said bottom portion of the block along a direction in compliance with said angle.

2. The connector as defined in claim 1, wherein said cavity is of a trapezoid cross-section configuration including an upward slanted side in compliance with said angle, two vertical parallel front side and end side, and a horizontal bottom side.

3. The connector as defined in claim 1, wherein said cavity is of a triangle cross-section configuration including an upward slanted side in compliance with said angle, a vertical end side and a horizontal bottom side.

4. The connector as defined in claim 2, wherein said attachment plate of the boardlock moves along the upward slanted side during insertion.

5. The connector as defined in claim 3, wherein said attachment plate of the boardlock moves along the upward slanted side during insertion.

6. The connector as defined in claim 2, wherein a pair of slots are formed in the cavity by two sides of the upward slanted side.

7. The connector as defined in claim 3, wherein a pair of slots are formed in the cavity by two sides of the upward slanted side.

8. The connector as defined in claim 1, wherein barbs are formed on two side edges of the attachment plate of the boardlock.

9. The connector as defined in claim 1, wherein an angle between the legs and the attachment plate is substantially smaller than a right angle.

10. The connector as defined in claim 1, wherein more than one boardlocks are provided on more than one block, respectively, and are not collinear along an elongated direction of the housing.

11. A boardlock for use with a slanted card edge connector, comprising:

an attachment plate with barbs on two opposite side edges; and leg means downward extending from at least one edge of said attachment plate; wherein said attachment plate defines a first plane and leg means defines a second plane, and an oblique angle is formed between said first and second planes.

12. A slanted connector (10) comprising an elongated housing (12) with a plurality of cavities (50) on an underside thereof for receiving a corresponding number of boardlocks (40) therein, said housing generally positioned at an angle, which is substantially smaller than a right angle, with regard to a PC board (100) on which the connector (10) is mounted, each cavity (50) defining an upward slanted side (54) generally in compliance with said angle as so to have the corresponding boardlocks (40) installed into said cavity (50) in a direction along said slanted side (54), each cavity (50) further including a horizontal bottom side (58) open to an exterior for allowing vertical leg means (44) of said boardlock (40) to extend downward therethrough into a hole of the PC board (100).

13. A slanted connector (10) comprising:

an insulative elongated housing (12) defining a top surface (11) at an angle relative to a PC board (100) on which the connector (10) is mounted;

at least a fixation section (50) formed adjacent a bottom portion (52) of the housing (12) for securing therein a boardlock (40), which includes a securing portion (42) and a leg portion (44), wherein said fixation section (50) includes at least an upward slanted side (54) in compliance with a direction along said angle for allowing said securing portion (42) of the boardlock (40) to be adapted to move therealong and be fastened thereto with said leg portion (44) extending downward out of a horizontal bottom side (58) of said fixation section (50) for reaching the PC board (100) and wherein said fixation section (50) further includes a vertical end side (56) for guidable confrontation with the leg portion (44) of the boardlock (40).

14. The connector as defined in claim 13, wherein said fixation section further includes a vertical end side for guidable confrontation with the leg portion of the boardlock.

* * * * *